United States Patent [19]

Reitano

[11] 4,111,415

[45] Sep. 5, 1978

[54] EXERCISING APPARATUS TO AID IN THE PRACTICE OF KARATE

[76] Inventor: Andrew Reitano, 2152 Ellis Ave., Bronx, N.Y. 10462

[21] Appl. No.: 756,873

[22] Filed: Jan. 5, 1977

[51] Int. Cl.[2] ..... A63B 21/12; A63B 21/14; A63B 21/16; A63B 69/22

[52] U.S. Cl. ..... 272/94; 272/68; 272/76; 272/126; 272/142

[58] Field of Search ..... 272/76, 77, 78, 93, 272/94, 116, 117, 126, 136, 142, 900, 68

[56] References Cited

U.S. PATENT DOCUMENTS

| | | | |
|---|---|---|---|
| 1,517,147 | 11/1924 | Burnett | 272/142 X |
| 1,978,499 | 10/1934 | Loveridge | 272/78 |

FOREIGN PATENT DOCUMENTS

| | | | |
|---|---|---|---|
| 516,092 | 12/1920 | France | 272/77 |
| 441,903 | 11/1948 | Italy | 272/136 |

OTHER PUBLICATIONS

Black Belt Magazine, Aug. 1974, p. 68, Maxiwara 72 – Item No. S32–21.

*Primary Examiner*—Anton O. Oechsle
*Attorney, Agent, or Firm*—Charles J. Speciale

[57] ABSTRACT

Exercising apparatus to aid in the practice of karate comprising an overhead horizontal support bar mounted between two vertical supports, a rotatable wheel mounted between the ends of the support bar, various exercising components being provided for connection to the support bar for inducing forced use of the various muscles of the body and hooks provided for removably joining the exercising components to the rotatable wheel on the support bar. One exercising component includes a pair of straps respectively attachable at one end to circumferentially spaced portions of the wheel, the other ends of the straps being respectively provided with a power hand grip and a foot grip. A second exercising component includes a spring, one end of which is attachable to the wheel and the other end is provided with a head strap and a chin strap. A third exercising component includes a solid rubber square karate kick target having straps attached to opposite ends thereof. The other ends of the straps are respectively attachable to the wheel and a floor attached loop.

1 Claim, 5 Drawing Figures

EXERCISING APPARATUS TO AID IN THE PRACTICE OF KARATE

BACKGROUND OF THE INVENTION

1. Field of the Invention:

This invention relates to exercising apparatus particularly suited to the practice of the martial arts, such as karate.

2. Description of the Prior Art:

The practice of the martial arts and particularly karate has been of great interest recently. Many schools now provide formal karate instruction. However, while the spirit has been willing the body has been many times very weak. It is to this problem that this invention is directed.

SUMMARY OF THE INVENTION

It is, therefore, among one of the principal objectives of this invention to provide an exercising apparatus especially suited to the forced use of various muscles of the body to supplement and increase the physical benefits enjoyed through the practice of karate.

In accordance with the present invention there is now provided an exercising apparatus which will accomplish the foregoing objectives comprising an overhead horizontal support bar mounted between two vertical supports, a rotatable wheel mounted between the ends of the support bar, various exercising components being provided for use and correction with said support bar for inducing the forced use of the various muscles of the body, and means provided by removably joining said exercising components to said rotatable wheel on said support bar. Additionally, floor anchoring means can be provided for associated use with the support bar when required.

BRIEF DESCRIPTION OF THE DRAWINGS

The invention will be hereinafter more fully described with reference to the accompanying drawings in which.

DESCRIPTION OF THE PREFERRED EMBODIMENTS

Figure 1:
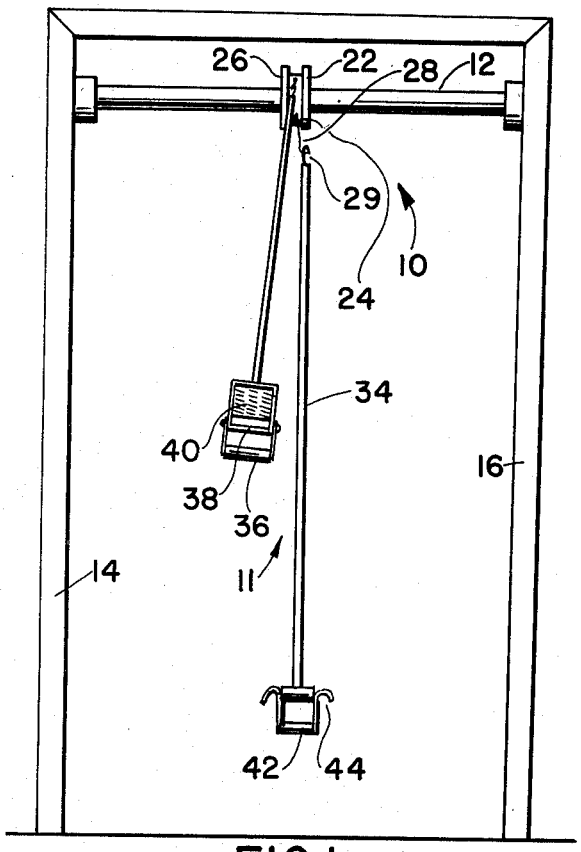
FIG. 1 is a front elevational view of the invention apparatus when employed with one of the various exercising components.
Figure 2:
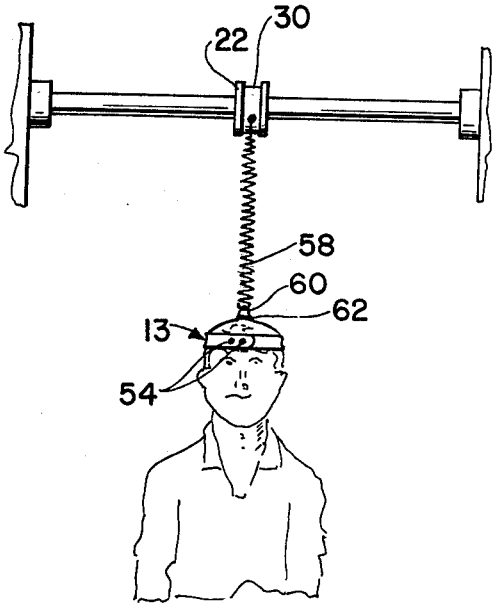
FIG. 2 is a view similar to FIG. 1 and showing another of the exercising components when applied to an individual.
Figure 3:
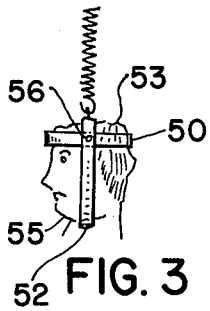
FIG. 3 is a side elevational view (fragmented) of the embodiment of FIG. 2.
Figure 4:
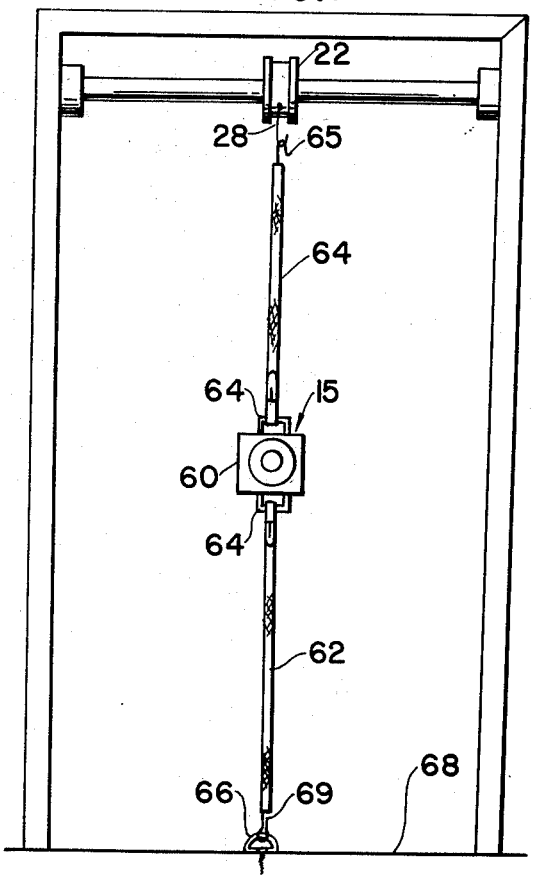
FIG. 4 is a view similar to FIG. 1 and showing yet another of the exercising components.

Referring now to the figures of the drawing there is shown therein the exercising apparatus 10 of the invention (hereinafter referred to as "apparatus") showing the various exercising components for use therewith. To wit, FIG. 1 shows the exercising component 11 for hand, arm, foot and leg muscle development; FIGS. 2 and 3 show the component 13 for neck muscle development; while FIG. 4 shows the component 15 for kick-timing ("Makiwara").

Figure 5:
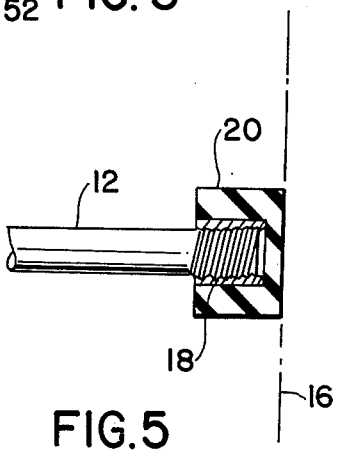
FIG. 5 is a fragmented, partially sectional view of one end of the horizontal as secured to the vertical support.

Turning now to the feature common to all the embodiments, apparatus 10 comprises an overhead horizontal support bar 12, mounted between two vertical, parallel opposing supports 14 and 16, such as a closet doorway entrance. Support bar 12 is made of a rigid material such as steel and is preferably tubular in shape. It is threaded at either end as at 18 and is threadingly secured to suitable mounts 20 provided on the vertical supports 14 and 16 (FIG. 5). This associated threading securement is conventional and need not be further discussed. Between the ends of the support bar 12, in a generally central location, is provided a rotatable wheel 22. Wheel 22 rotates in a circular seat 24 provided for that purpose in the support bar. A pair of steel hooks 26 and 28 are provided on the rim 30 of the wheel in a spaced manner so that a pulley action may be accomplished as will be seen shortly.

Returning now to the exercising component 11 shown in FIG. 1, component 11 comprises a pair of elongated straps 32 and 34 removably connected to hooks 26 and 28, respectively, with associated like hooks 29 provided on the upper ends of the straps. The lower end of strap 32 is provided with a hand grip 36 which in turn has a power grip 38 consisting of springs 40 which can be tensionally drawn together by hand squeezing the power grip. The lower end of strap 34, on the other hand, is provided with a foot grip 42, for insertion of a foot of the user, which foot grip 42 is adjustable by means of a buckle 44. Thus, in order to exercise, the user grasps hand grip 36 and tensionally grasps the power grip 38; at the same time, he inserts his foot in foot grip 42. He then proceeds to raise and lower his foot and arm in alternate succession, the action of bringing the foot down raising the strap 32 and the action of pulling the hand grip down raising the foot. This is the pulley action previously mentioned. By this exercise, muscles in the hands, arms, shoulders and feet, among others, can be developed.

With reference to FIG. 2, component 13 comprises a head strap 50 and a chin strap 52. Head strap 50 goes around the head 53 while chin strap 52 goes over the top of the head and under the chin 55 of the user. Snaps 54 are provided on the head strap so that the straps can be secured to the head. The head and chin straps are suitably riveted as at 56 at their two intersecting points (one is shown in FIG. 3, the other is on the other side of the head, not shown). Further, a tensionable spring 58 of suitably strong material is securable to the head strap 50 by means of a hook 60 on one end of the spring and an associated metal loop 62 provided on the head strap in a position centrally located on the top of the head. The other end of the spring 58 is removably secured to hook 26 or 28 (either one) on the wheel 22. It can be seen, then, that by pulling down on the spring 58 via the chin strap 52 that the muscles of the neck of the exercising individual will be tensionally stretched and released as desired.

Finally, turning to FIG. 4, component 15 comprises a "Makiwara" 60 (i.e., for kick timing) made of a solid rubber square mounted between two adjustable straps 62 and 64 (adjustable such as an ordinary belt) by means of links 64 on the upper and lower ends of the "Makiwara" 60. Strap 64 in turn is removably secured to hook 26 or 28 on the wheel 22 by its own hook 65, while strap 62 is removably secured to a metal loop 66 screwed to the floor 68 of the closet entrance by its own hook 69. By adjusting the "Makiwara" up or down by means of the adjustable straps 62 and 64, the exerciser can practice his kick timing at various heights. Kick timing is of course important to the development of the foot, leg and hip muscles, among others.

Thus, what we have provided here is an exercising apparatus to aid in the practice of karate which is simple to assemble, takes up very little space, and moreover since it is readily disassemblable, the exercising components can be taken down and stored in a small box until ready for re-use. With regard to the support bar, if it is installed deep enough the closet door will cover it up.

What is claimed is:

1. An exercising apparatus to aid in the practice of the martial arts which comprises an overhead horizontal support bar, said support bar being mounted between a pair of parallel opposing vertical support members, a wheel in turn rotatably mounted to said support bar between the opposing ends thereof, a first exercising component, a second exercising component, and a third exercising component, and means for removably connecting said first, second, and third exercising components with said wheel on said support bar, and wherein said first exercising component comprises a pair of straps whose upper ends each have a hook joined thereto, a pair of hooks in spaced circumferential relation being joined to the rim of said wheel, said hooks on said upper ends and on said rim being in removably connectible association, each of said pair of straps having a lower end, one lower end being provided with a tensionable hand grip, the other lower end being provided with an adjustable foot grip, the spaced circumferential relation allowing for a pulley action when said straps are alternately raised and lowered by means of said hand and foot grips, respectively.

* * * * *